US006269615B1

(12) United States Patent
Amborn et al.

(10) Patent No.: US 6,269,615 B1
(45) Date of Patent: Aug. 7, 2001

(54) APPARATUS FOR HANDLING AND PACKAGING FRIABLE TABLETS

(75) Inventors: Jerry Amborn, Spring Lake Park; Vernon Tiger, Minneapolis, both of MN (US)

(73) Assignee: Cima Labs, Inc., Eden Prairie, MN (US)

( * ) Notice: Subject to any disclaimer, the term of this patent is extended or adjusted under 35 U.S.C. 154(b) by 0 days.

(21) Appl. No.: 09/264,994

(22) Filed: Mar. 9, 1999

Related U.S. Application Data

(60) Provisional application No. 60/077,363, filed on Mar. 9, 1998.

(51) Int. Cl.[7] ..... B65B 3/26; B65B 57/00

(52) U.S. Cl. ..... 53/493; 53/235; 53/246; 53/247; 53/329.3; 53/543; 53/525

(58) Field of Search ..... 53/539, 246, 247, 53/251, 235, 158, 147, 448, 443, 478, 329.3, 559, 560, 900, 543, 525, 367, 437, 493

(56) References Cited

U.S. PATENT DOCUMENTS

| | | |
|---|---|---|
| 2,735,599 | 2/1956 | Thurman . |
| 3,142,947 | 8/1964 | Walter . |
| 3,722,173 | 3/1973 | Noguchi . |
| 4,435,941 | 3/1984 | Booth et al. . |
| 4,555,894 | 12/1985 | Illy . |
| 5,040,357 | 8/1991 | Ingemann . |
| 5,157,895 | 10/1992 | Shibauchi et al. . |
| 5,178,878 | 1/1993 | Wehling et al. . |
| 5,223,264 | 6/1993 | Wehling et al. . |

*Primary Examiner*—Peter Vo
*Assistant Examiner*—Luis K. Huynh
(74) *Attorney, Agent, or Firm*—Lerner, David, Littenberg, Krumholz & Mentlik, LLP

(57) ABSTRACT

An assembly for handling and packaging pharmaceutical dosage forms includes an infeed structure, a laning structure, and a plenum structure extending from the infeed structure to the laning structure. The infeed, laning and plenum structures guide dosage forms as they are carried in a downstream direction by a surface movable with downstream direction. A guide portion guides the dosage forms into the laning structure to avoid jamming of tablets. A form handling device receives dosage forms and transports the dosage forms to a packaging device. A timed controller and dump gate operate so that debris is carried out of the assembly. The assembly is particularly useful for fragile dosage forms. A packaging device having a bottom plate with floatably supported blocks is provided for sealing dosage forms into packages.

6 Claims, 11 Drawing Sheets

APPARATUS FOR HANDLING AND PACKAGING FRIABLE TABLETS

CROSS-REFERENCE TO RELATED APPLICATIONS

This application claims benefit of U.S. Provisional Application Serial No. 60/077,363, filed Mar. 9, 1998, the disclosure of which is hereby incorporated by reference herein.

FIELD OF THE INVENTION

The present invention relates to an apparatus for handling and packaging pharmaceutical dosage forms, particularly fragile dosage forms.

BACKGROUND OF THE INVENTION

The present invention can be applied to systems or assemblies for packaging essentially any dosage form. Such systems may include a forming device such as a tablet press, an infeed structure, a laning structure, robotic devices for handling or carrying dosage forms, and a packaging machine. A series of conveyor belts and ramps transport the dosage forms through the packaging system. After the dosage forms are made, they proceed through the system and are controlled and organized for receipt by a packaging machine. A robotic handler may be used to transport dosage forms to the packaging machine. If the system packages dosage forms into blister packages, a robotic handler may be used to transport dosage forms to a sheet of packaging material, which will be sealed with a second sheet of material to form packages of the dosage forms.

The dosage forms travel through the packaging system rapidly and in large volumes. As many as 800 to 1,440 tablets per minute, or more, may be assembled into 240 packages of tablets per minute, or more. Hence, a displaced machine part, one of the dosage forms, or other debris anywhere in the system can cause dosage forms to break and improperly formed packages. Some systems must be shut down so that the jammed product or other debris may be cleared manually. This results in a loss of the product in large numbers before the system can be interrupted and the problem remedied.

The foregoing problems are exacerbated where the dosage forms are particularly susceptible to damage. This is true for packaging systems for relatively soft tablets. Such soft tablets include certain embodiments described in commonly assigned U.S. Pat. Nos. 5,178,878 and 5,223,264, the disclosures of which are hereby incorporated by reference herein. These tablets include, in addition to the active ingredients, an effervescent composition so that when the tablet is orally administered to a patient, it disintegrates. The tablets are very soft with a hardness typically below about 20 Newtons and in some cases below 10 Newtons. As a result, the packaging system must take into account the fragile nature of the product by providing means for avoiding jamming and backing up within the system and adequate arrangement of the product for packaging. Despite efforts in the art, still further improvements would be desirable.

SUMMARY OF THE INVENTION

The present invention addresses these needs.

One aspect of the present invention provides an assembly for handling and packaging pharmaceutical dosage forms. The assembly in accordance with this aspect includes an infeed structure for accepting a series of dosage forms including a surface movable in a downstream direction, a laning structure defining a plurality of lanes extending in the downstream direction and having a downstream end, and a plenum structure extending from the infeed structure to the laning structure, including a guide portion for guiding dosage forms carried by said surface into the laning structure. A form handling device is provided for receiving dosage forms and transporting dosage forms from the laning structure to a packaging device. A dump gate has a closed position in which the dump gate blocks the lanes at the downstream ends of the lanes. In the closed position, dosage forms will accumulate in the lanes. The dump gate also has an open position in which the dump gate does not block the lanes. A timed controller is provided for opening the dump gate after the handling device receives dosage forms so that debris will be carried downstream out of the laning structure after the form handling device receives dosage forms from the laning structure. This aspect of the invention provides a dosage form handling assembly which clears the laning structure of debris without excessive loss of undamaged dosage forms. The timed controller is preferably arranged so that debris is carried out of the laning structure and the dump gate is brought into its closed position before undamaged tablets escape the planing structure. The timed controller preferably comprises a computer communicating with the form handling device and the dump gate.

In preferred embodiments, a guide wall structure defines the guide portion which preferably includes a curved portion. The guide wall structure also preferably defines the plenum structure which preferably includes a plenum entry. In preferred embodiments, the guide wall structure is shaped to guide dosage forms entering the plenum structure so that the dosage forms enter the plenum entry adjacent a first side of the laning structure and travel in a first direction transverse to the downstream direction toward a second side of the laning structure before entering the lanes of the laning structure. In certain preferred embodiments, the curved portion of the guide wall structure includes a member adjacent the plenum entry. A biasing means or biasing device is provided in certain preferred embodiments for vibrating the member to agitate the dosage forms and relieve jamming of dosage forms. The biasing means may comprise a shaker for vibrating the member. The guide wall structure and moveable member is provided to guide fragile dosage forms from the infeed structure to the laning structure for organizing the dosage forms to be placed into packages. The transition between the infeed structure and the laning structure in this aspect of the invention is shaped to prevent jamming or a bottleneck effect in this transitional area which may result in damage to or destruction of the dosage forms.

The laning structure preferably includes a surface for supporting the dosage forms. This surface, in certain preferred embodiments, slopes in the downstream direction to the dump gate so that debris is carried out of the laning structure when the dump gate is in the open position.

Another aspect of the invention provides a packaging device, comprising a top plate and a bottom plate for engaging a packaging material and a lid stock therebetween to seal the packaging material and the lid stock to one another. At least one of the top plate and bottom plate is comprised of a plurality of blocks and a base for supporting the plurality of blocks thereon. The blocks are floatably supported by the base and individually moveable with respect to the base so that pressure applied to the package material and the lid stock by the top and bottom plates is evenly distributed. This aspect of the invention provides a more evenly and more reliably sealed package.

In preferred embodiments, each of the blocks is free to tilt relative to the base in all directions. The base may include a ball-like member for each block and each block may include a corresponding circular cavity formed at a second surface of each block opposite to the first surface on which the packaging material is engaged. The cavity receives the ball-like member so that the block is floatably supported by the base. In preferred embodiments, either the top plate, the bottom plate or both are heated for sealing the package material and the lid stock together to form a package for the dosage form.

Another aspect of the invention provides an assembly for guiding pharmaceutical dosage forms in a packaging assembly, comprising a surface movable in a downstream direction, a laning structure extending in a lateral direction transverse to the downstream direction and defining a plurality of laterally spaced lanes extending in the downstream direction. The assembly also comprises guide wall structures including a curved portion and a wall structure defining a plenum upstream of the laning structure. The curved portion guides the dosage forms carried by said surface so that dosage forms enter the plenum structure at a plenum entry adjacent a first side of the laning structure and travel laterally toward a second side of the laning structure before entering the lanes. The assembly preferably includes a form handling device for receiving dosage forms and transporting dosage forms from the laning structure to a packaging device. The packaging device may include a top plate and a bottom plate for engaging a packaging material and a lid stock therebetween to seal the packaging material and lid stock together, forming packaged dosage forms. The assembly may include a top plate and bottom plate including a plurality of blocks and a base for floatably supporting the blocks. The lanes may have a downstream end and the assembly may further comprise a dump gate at the downstream end, having an open position and a closed position. A timed controller may be provided for opening the dump gate after the handling device receives dosage forms so that debris will be carried downstream out of the laning structure.

BRIEF DESCRIPTION OF THE DRAWINGS

These and other features, aspects, and advantages of the present invention will become better understood with regard to the following description, appended claims and accompanying drawings, where:

DETAILED DESCRIPTION OF THE PREFERRED EMBODIMENTS

Figure 1:
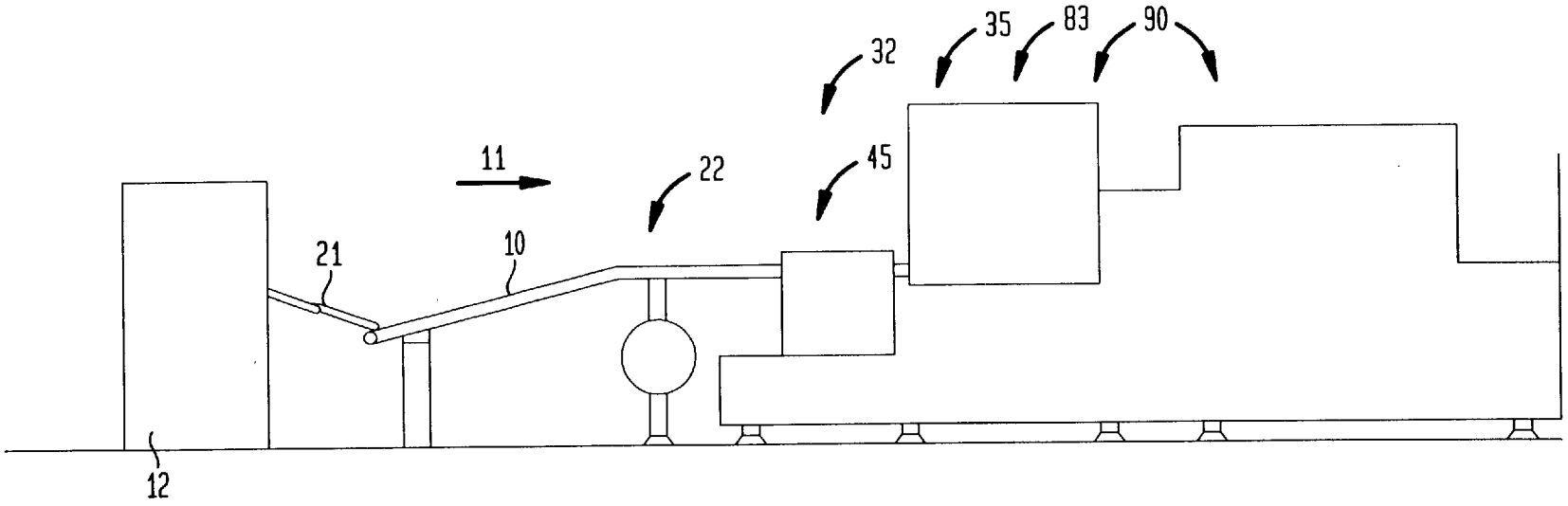
FIG. 1 is a schematic elevation of an assembly for handling and packaging pharmaceutical dosage forms in accordance with an embodiment of the invention.

One embodiment of an assembly for handling and packaging dosage forms in accordance with the invention is depicted in FIGS. 1–9. An infeed structure 22, a laning structure 35 and a plenum structure 32 extending between the infeed structure and the laning structure arrange dosage forms such as tablets into rows so that they can be arranged into packages. The dosage forms handled by the assembly may be any type of dosage form, including tablets, capsules, pills, pellets, and other forms. The assembly is particularly useful for fragile dosage forms.

The tablets are transported throughout the assembly on a movable surface or conveyance device, such as a conventional conveyor belt. A rotating drum or disk may also be used. The conveyor belt is driven by any conventional means 13 such as an electric motor or other conventional drive so that the upper run 10 of the belt moves in a downstream direction 11. The motor is controlled by a switch and a control device for starting and stopping the conveyor belt and varying the speed of the conveyor belt. The conveyor belt is adjacent a tablet press 12 which forms tablets 15. The tablets travel from the tablet press down a ramp 21 to the conveyor belt. The ramps, as well as the other surfaces used in the assembly which contact the tablets, are preferably made of a smooth material which will not interfere with the sliding of the tablets to the next stage of the system. Many plastics and other materials may be used. Alternatively, the ramps and other surfaces may be coated with a smooth material such as a fluoropolymer of the type sold under the trademark TEFLON to promote the sliding of the tablets.

Figure 5:
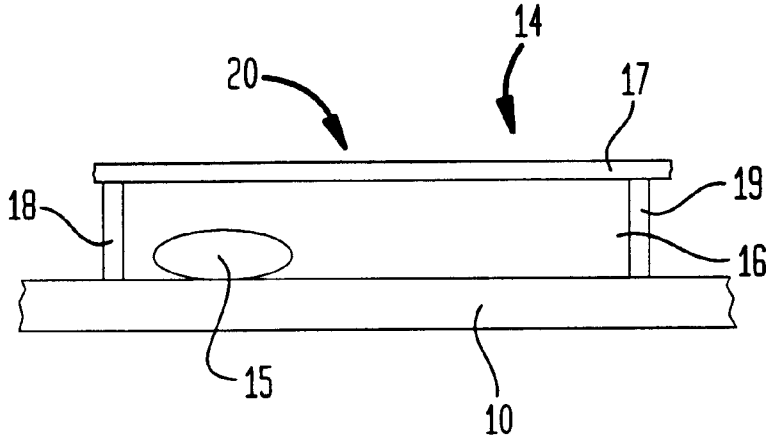
FIG. 5 is a cross section taken along line 5—5 in FIG. 3.

The upper run 10 of the belt receives tablets 15 from the tablet press 12 and conveys the tablets in the downstream direction 11. The infeed structure 22 includes a guide wall structure 14 is disposed over the upper run 10 of the conveyor belt, and guides the tablets as they move downstream with the belt. The speed of the conveyor belt is variable in a range from about 40 to 100 feet per minute. The guide wall structure 14 defines a channel 20 over the upper run 10 of the belt extending from the tablet press to the laning structure. The channel 20 has a top wall 17, a first side wall 18, a second sidewall 19 and an open bottom 16, as shown in FIG. 5. The open bottom 16 of the channel 20 faces toward the upper run 10 of the conveyor belt, so that tablets 15 disposed on the belt are moved downstream within the channel 20 and are guided by the top wall 17, first sidewall 18, and second sidewall 19.

Figure 2:
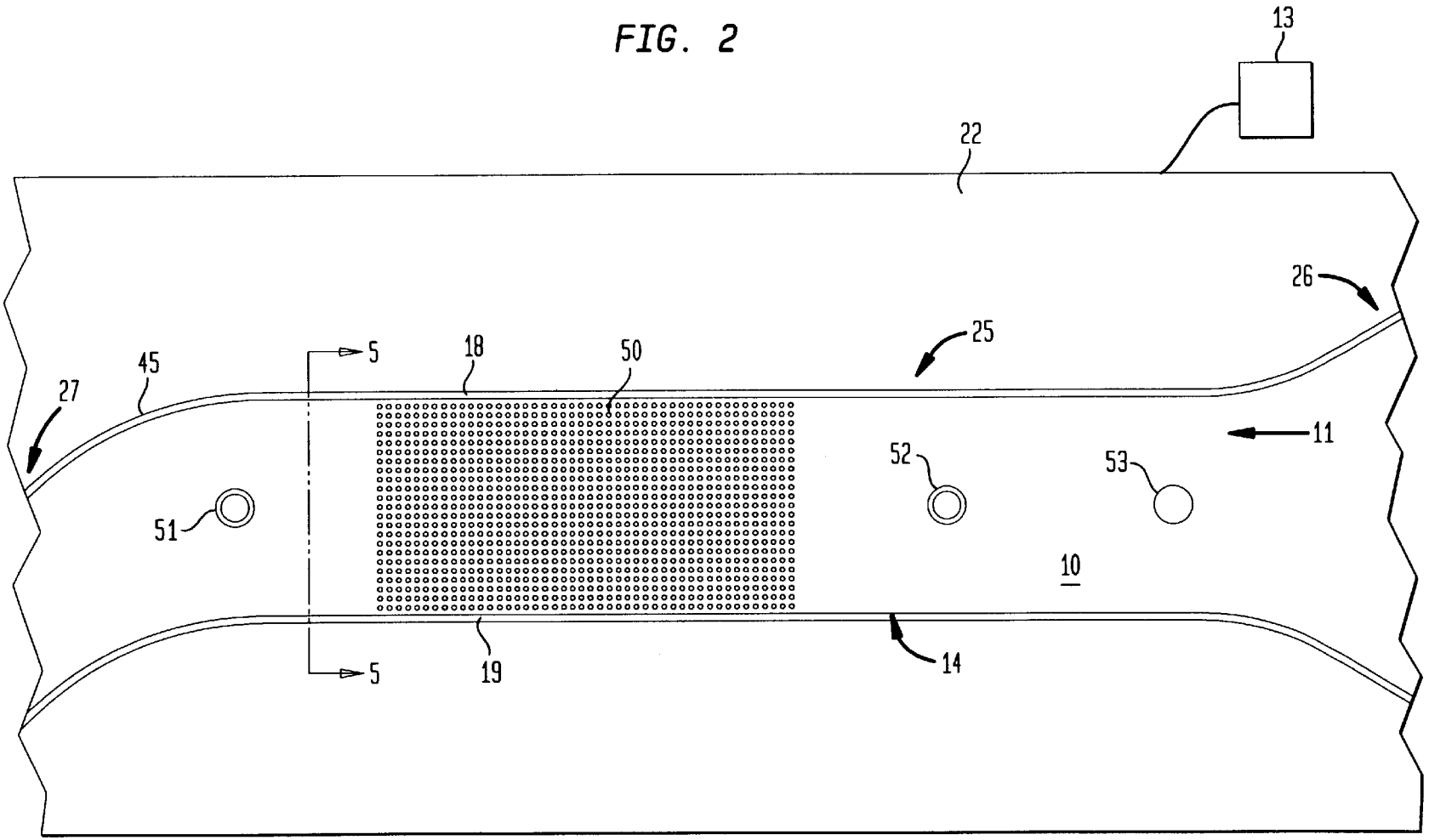
FIG. 2 is a schematic top plan view of an infeed structure for the embodiment of FIG. 1.
Figure 3:
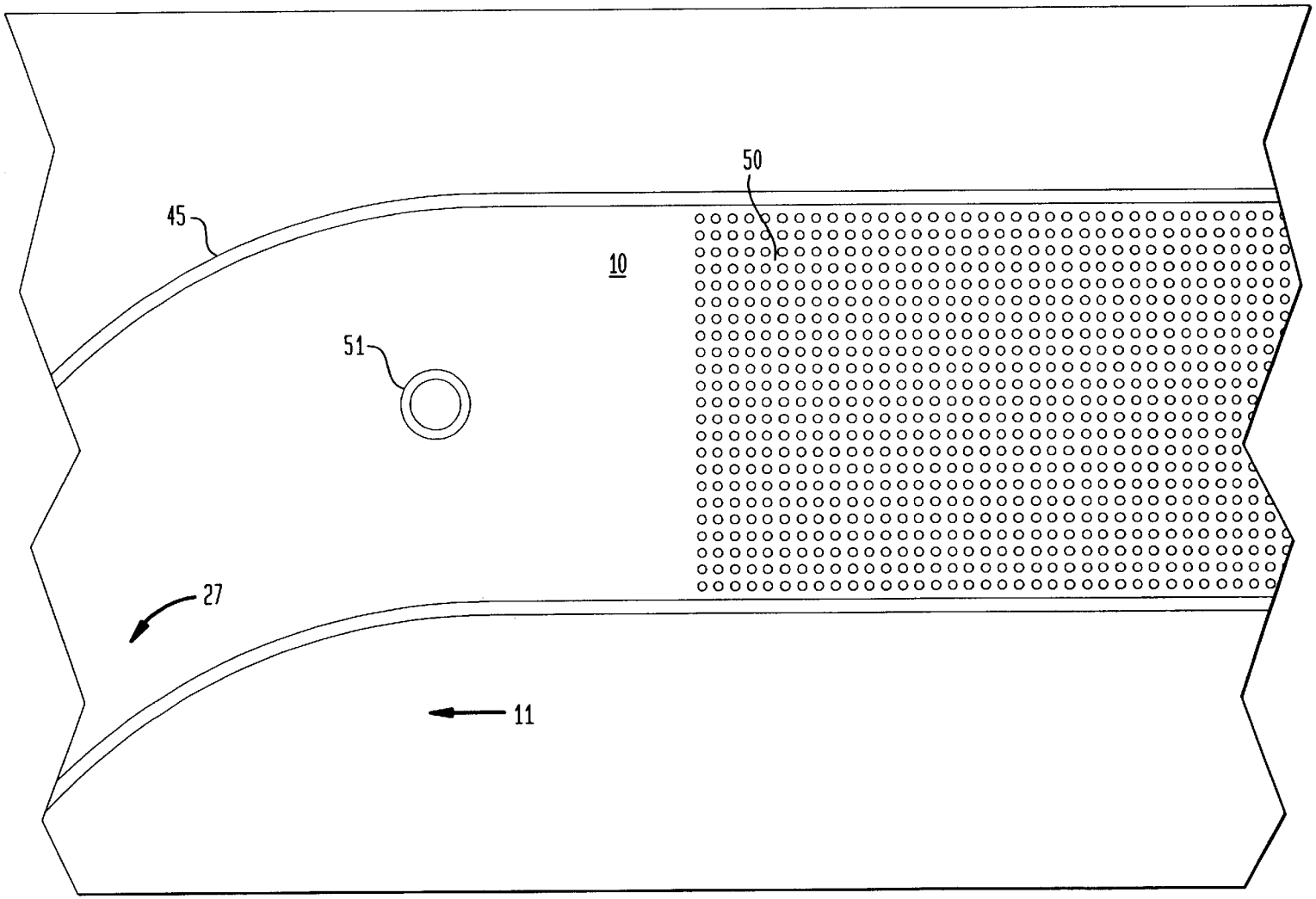
FIG. 3 is a detail of the view of FIG. 2 showing a part of the infeed structure in the embodiment of FIGS. 1–2.
Figure 4:
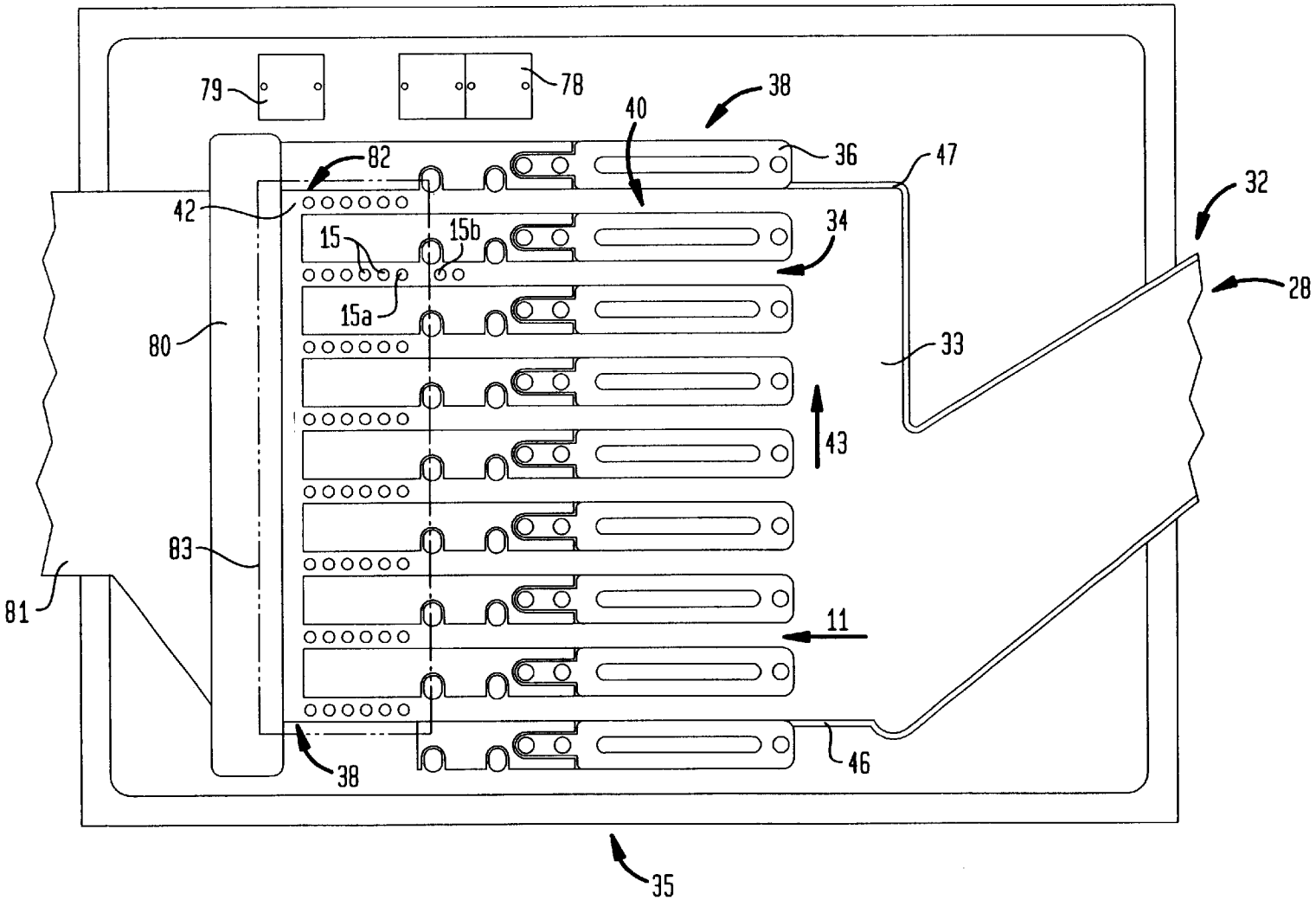
FIG. 4 is a schematic top plan view of a laning structure in accordance with the embodiment of FIGS. 1–3.

As depicted in FIG. 2, the guide wall structure 14 includes a guide portion 25, having an entry 26 adjacent the tablet press 12 and an exit 27 adjacent a plenum structure 32. The guide wall structure also defines the plenum structure 32, having a plenum entry 28 adjacent the exit 27 and a transitional portion 33, as depicted in FIGS. 2–4. The transitional portion guides tablets into the laning structure which is typically wider than the guide portion 25, which causes tablets to back up to the juncture between the guide portion and transitional portion. Thus, the guide portion 25 includes a curved portion 45 of the guide wall structure 14 is preferably provided for guiding the tablets into the wider transitional portion 33 of the plenum structure 32. The transitional portion 33 is adjacent an inlet end 34 of the laning structure 35. The laning structure 35 has a first side 46 and a second side 47 and includes a series of finger members 36. The finger members 36 extend in a downstream direction 11 from the inlet end 34 of the laning structure to a downstream end 38 of the laning structure 35. The finger members 36 define lanes 40 which are spaced from each other in a lateral direction 43 transverse to the downstream direction 11. The lanes arrange the tablets into rows 42.

Although tablets of almost any size can be packaged in an apparatus in accordance with the invention, the dimensions of the guide wall structure depends upon the size of the tablet or other dosage form. The embodiment shown in FIGS. 1–9 is designed to handle tablets having a ¼" diameter, but the dimensions provided below may be varied for tablets having a 11/16", ½", or ⅝" diameter, or other sizes and types of dosage forms. The thickness of the tablets range from about 0.100" to 0.320". Although the dimensions of the guide wall structure 14 vary with the size of the dosage form handled in the system, the channel 20 in the embodiment of FIGS. 1–9 has a width of 5⅞" at the section shown in FIG. 5 and a length of 39¾" and the height of the channel is equal to the tablet thickness plus 0.040". The curved portion 45 has the same width as the channel 20 and is defined by the guide wall structure 14. The transition portion 33 in the embodiment of FIG. 4 has a width of 14⅞". The width of the transitional portion is the dimension transverse to the downstream direction 11.

The lanes 40 depicted in FIG. 4, extend in the downstream direction 11 and are spaced apart from one another in the lateral direction 43. The finger members 36 of the laning structure 35 preferably comprise vibrating guide members 36 which assist in moving the tablets downstream. The lanes for the ¼" tablets are ⅝" wide and 12⅛" long. The vibrating members are attached to a selectively operable actuator or actuators 78 such as a solenoid, electric motor operated actuator, hydraulic cylinder or, most preferably, an air cylinder for vibrating the guide members 36. The vibrating members agitate the tablets so that they move downstream within the lanes to the downstream end 38. In preferred embodiments, the vibrating members which define the lanes are preferably formed with an aperture separating two side bars, so that each bar can be replaced in the event that they become warped or otherwise damaged.

A dump gate 80 is positioned at the downstream end 38 of the laning structure 35. Adjacent the downstream end 38 is a tablet pickup area 82 of the lanes 40. Adjacent the dump gate on a side of the dump gate opposite the pickup area 82, is a discard ramp 81. In the closed position illustrated in FIG. 4, the dump gate blocks the downstream end 38 of each lane 40. The downstream motion of the conveyor belt beneath the laning structure carries tablets downstream until the leading or most downstream tablet in each lane stops against the closed dump gate. In certain embodiments, the laning structure includes a surface beneath the lanes which is sloped in the downstream direction 11 to encourage tablets and other debris to move toward the downstream end 38 of the laning structure 35.

A form handling device 38 is disposed above the pickup area 82 of the lanes 40. In preferred embodiments, the form handling device 38 comprises a robotic handler including an array of finger-like channels 64, a soft rubber suction cup 65 on each such finger 64, and a vacuum pump connected to the finger-like channels 64 for applying suction through the suction cups so that the suction cups can receive and lift the tablets 15. The robotic handler 83 receives the tablets and transports them to the packaging machine, where the tablets are released by releasing the vacuum. In other embodiments, other "pick and place" form handlers are used to transport tablets from pickup area 82 to the packaging machine.

Figure 4A:
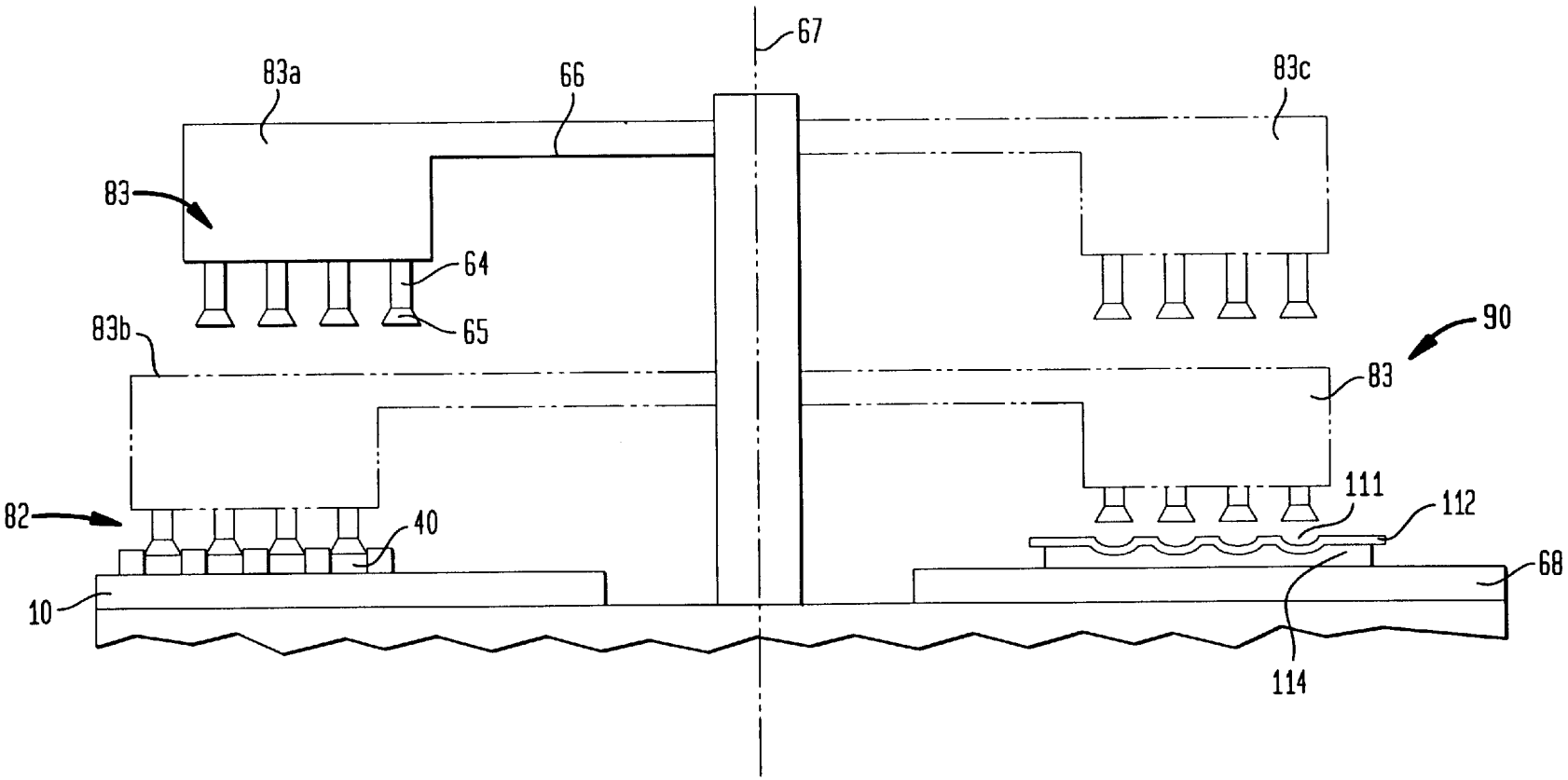
FIG. 4A is a sectional view of a preferred form handler in the embodiment of FIGS. 1–4.

The array of finger-like channels 64 preferably comprises a two-dimensional array of the channels 64, arranged in a carriage assembly connected to an arm 66 rotatable around a vertical axis. A suction cup 65 of each channel 64 corresponds to a tablet arranged in the pickup area 82 of the lanes, as depicted in FIG. 4A. After lifting the tablets, the arm 66 of the robotic hander carries the tablets to the packaging machine.

The dump gate is attached to a selectively operable actuator 79 such as a solenoid, electric motor operated actuator, hydraulic cylinder or, most preferably, an air cylinder for opening and closing the dump gate. A number of air cylinder models may be used and the type of air cylinder depends upon the size tablet being packaged. The actuator is linked to a control device such as a mechanical, fluidic, electronic or electromechanical controller of known type which is also linked to the robotic handler. In preferred embodiments, the controller is a programmable, computer actuated controller having functions controlled by software.

In preferred embodiments, a detection system with three (3) sensors spaced along the infeed structure 22 is provided for detecting a backup of tablets in the guide wall structure 14. The first sensor 51 is located adjacent the exit 27 of the guide portion proximate to the curved portion 45, as depicted in FIG. 2. The first sensor 51 provides an indication that the curved portion 45 is clear and to turn on the tablet press 12 and commence flow of tablets through the packaging system. The second sensor 52 produces an indication that the tablets have backed up from the exit 27 to the second sensor 52 and that the tablet press rate should be reduced. The third sensor 53, located at the entry 26 of the guide portion 25, produces an indication that the tablets backed up to the third sensor 53 and to turn off the tablet press. Software and computer hardware may be provided to receive the indications from the sensors and to control the operation of the tablet press.

Where the tablets handled by the system are of the soft, fragile type discussed above, dust is generated within the channel 20 from the tablets 15 moving therein. Thus, preferred embodiments include a guide wall structure 14 having vacuum holes 50 for dedusting the channel 20. A vacuum is preferably attached to the top wall 17 of the guide wall structure 14 for this purpose. The guide wall structure 14 is preferably formed from a plastic material which is also preferably transparent for visual observation of the tablets transported within the system.

In operation, tablets are carried in the downstream direction 11 on the upper run 10 of the conveyor belt, through the guide wall structure 14. The tablets are guided through the curved portion 45 to the plenum structure 32 and travel through the transitional portion 33. In the transitional portion 33, the tablets generally travel from the first side 46 in the lateral direction 43 toward the second side 47 of the laning structure 35 before entering the lanes 40. Upon entering the lanes, the tablets travel in the downstream direction 11.

With the dump gate 80 closed, a row 42 of tablets stack up in upstream-to-downstream order within the tablet pickup area 82 of each lane 40. The form handling device 83, engages the tablets 15 stacked within the various lanes 40 and lifts a predetermined number of tablets out of each lane during each cycle of operation. The operation of the embodiment having the robotic tablet handler will now be described. As depicted in FIG. 4A, the robotic tablet handler descends from a first position 83A to a second position 83*b* to receive the tablets within the lanes 40. For ease of illustration, only a few of the lanes 40 depicted in FIG. 4 are depicted in FIG. 4A. The vacuum is applied and the tablets are received within the suction cups 65. The arm 66 raises the array of finger-like channels 64 and suction cups 65 to position 83*a* and rotates 180° to position 83C, over the packaging machine 90. In the pickup area 82 of the lanes 40, the tablet 15*b* immediately after the last tablet 15*a* lifted by the robotic handler 83 then becomes the leading tablet of the next group to be received be the robotic tablet hander 83.

During each cycle of the robotic handler, the controller operates the actuator in synchronism with the handler 83 or other form handling device so that the dump gate 80 opens after the handler 83 has engaged a group of tablets and remains open for a preselected open time after the handler 83 has lifted that group of tablets out of the laning structure 35. While the dump gate is open, debris accumulated in each lane moves downstream, past the dump gate 80 and down the discard ramp 81, where debris is collected for disposal. The next group of tablets move downstream to the downstream end 38. The open time of the dump gate 80 is selected so that it is just slightly less than the time required for the leading tablet of the next group to reach the downstream end 38 of the lane 40. Thus, the dump gate 80 returns to the closed position just before the leading tablet (for example, tablet 15*b*) of the next group arrives at the dump gate 80. This cycle of operations is repeated.

The dump date may be manually operated in some embodiments, which is less preferred. Attempts have been made heretofore to use a dump gate which is manually actuated by an operator in response to visible accumulation of debris in the lanes, or which is actuated at some lengthy intervals. Where the dump gate is manually operated, debris such as tablets or parts of tablets missed by the robotic tablet handler interfere with the next set of tablets preceding to the pickup area 82 through the lanes 40. Breakage of tablets occurs in the laning area before a human operator is alerted who can operate the dump gate. Also, when the manually operated dump gate is held open, some good tablets pass out of the dump gate and are wasted. By contrast, in the preferred systems according to this aspect of the invention, debris is cleared during each cycle of the handler, without wasting good tablets.

Figure 10:
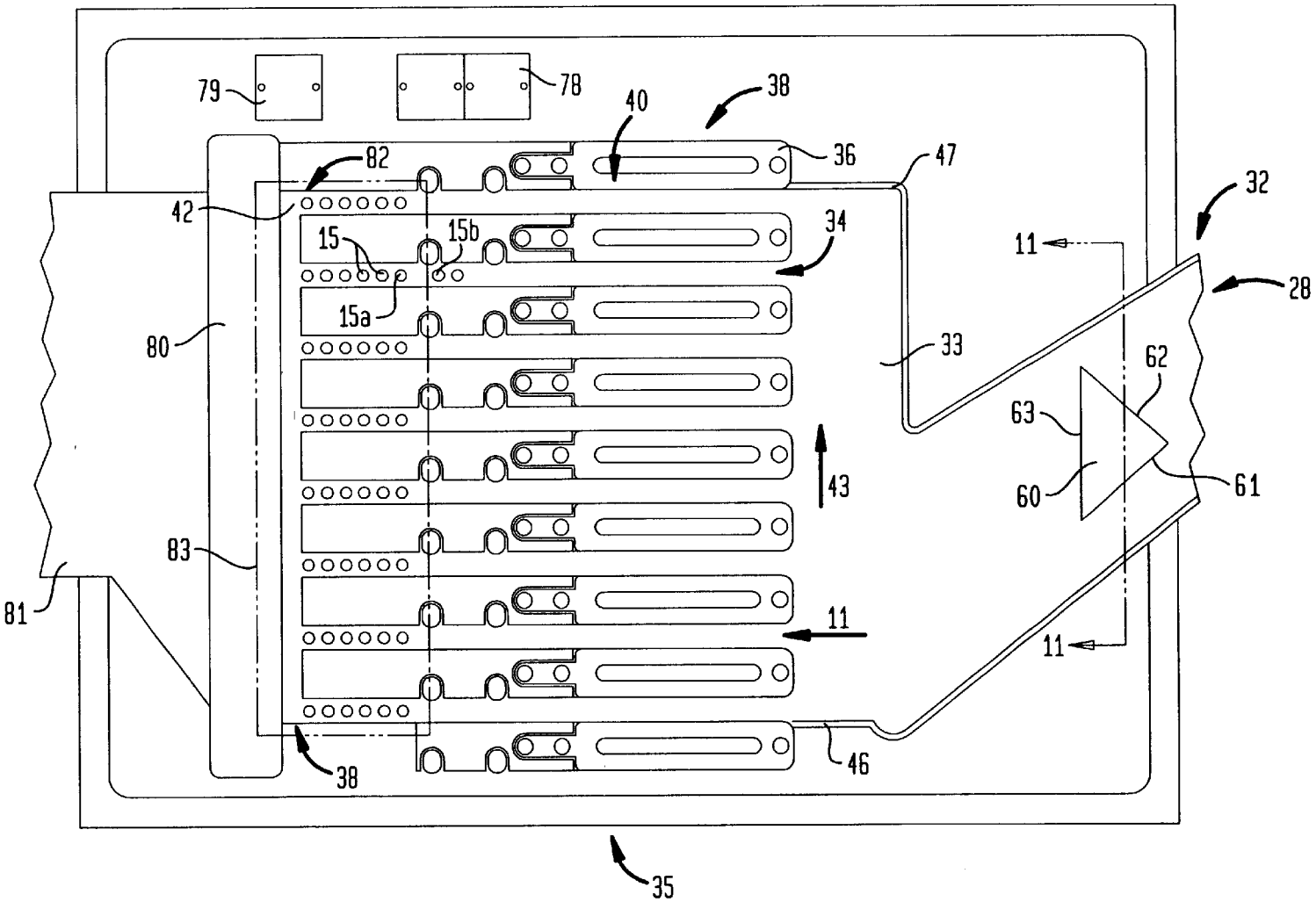
FIG. 10 is a FIG. 4 is a schematic top plan view of a laning structure in accordance with another embodiment.
Figure 11:
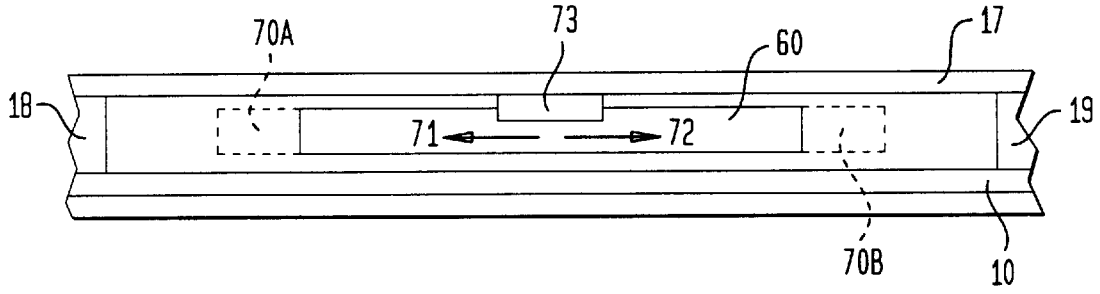
FIG. 11 is a section taken along line 11—11 in FIG. 10.

Other embodiments of the invention include an infeed structure, a plenum structure and a laning structure adapted to different sized tablets and different types of dosage forms. Certain preferred embodiments also include a member 60, preferably having a triangular shape, at the juncture of the guide portion 25 and the plenum structure 32. The triangle 60 alleviates jamming of the tablets at this juncture. It has been found that this triangular member 60 is not required for ¼" tablets in the embodiment of FIGS. 1–9, but is preferred for larger tablets. For example, in packaging ½" tablets, a stationary triangular member is preferably used to alleviate jamming. For ⅝" tablets, a triangular member which is spring-loaded is preferably used. The triangular member, depicted in FIGS. 10 and 11, has a first leg 61 and a second leg 62 facing upstream and a third leg 63 facing downstream, facing the laning structure 35. The spring-loaded triangular member 60 is moveable from side to side in traverse directions 71 and 72 shown in FIG. 11, transverse to the downstream direction 11. The triangle is biased in a central position 70 by a biasing means 73, including a spring or other conventional biasing devices. The tablets bounce off the triangle, which alleviates jamming of the tablets in the plenum entry 28. Tablets entering the plenum entry may slide along the first leg 61 and second leg 62 and proceed to the transitional portion 33. However, in the event that tablets begin to jam up, the tablets apply a small force upon the triangular member, which compresses the biasing device or spring 73. As shown in FIG. 11, the triangle may be moved to one side or the other to offset positions 70*a* or 70*b*. The spring reacts, relieving the force of the tablets. The compressibility of the spring must be such that the tablets are not broken.

Figure 6:
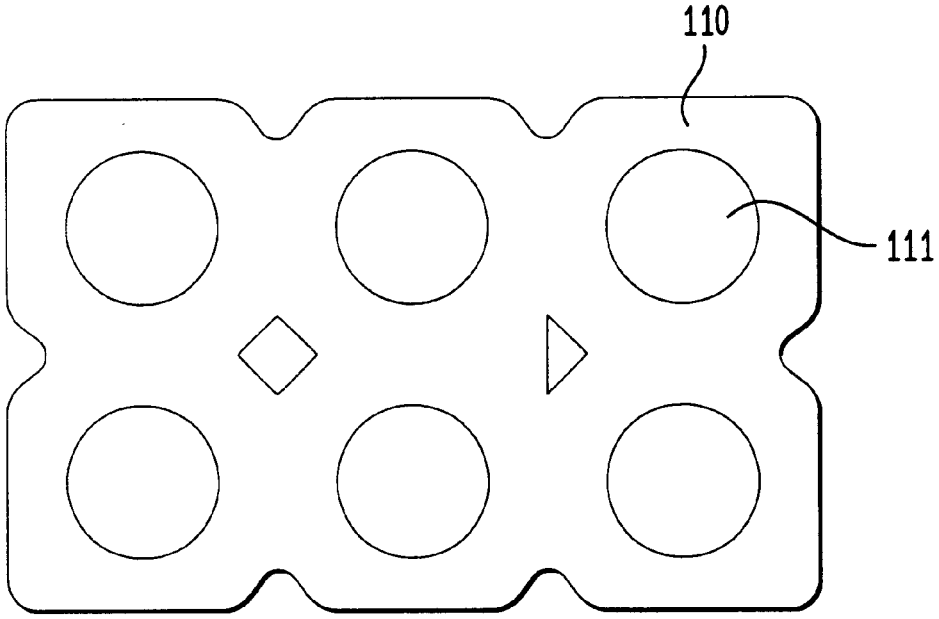
FIG. 6 is a plan view of a package which may be formed in the apparatus in accordance with the embodiment of the invention of FIGS. 1–5.
Figure 7:
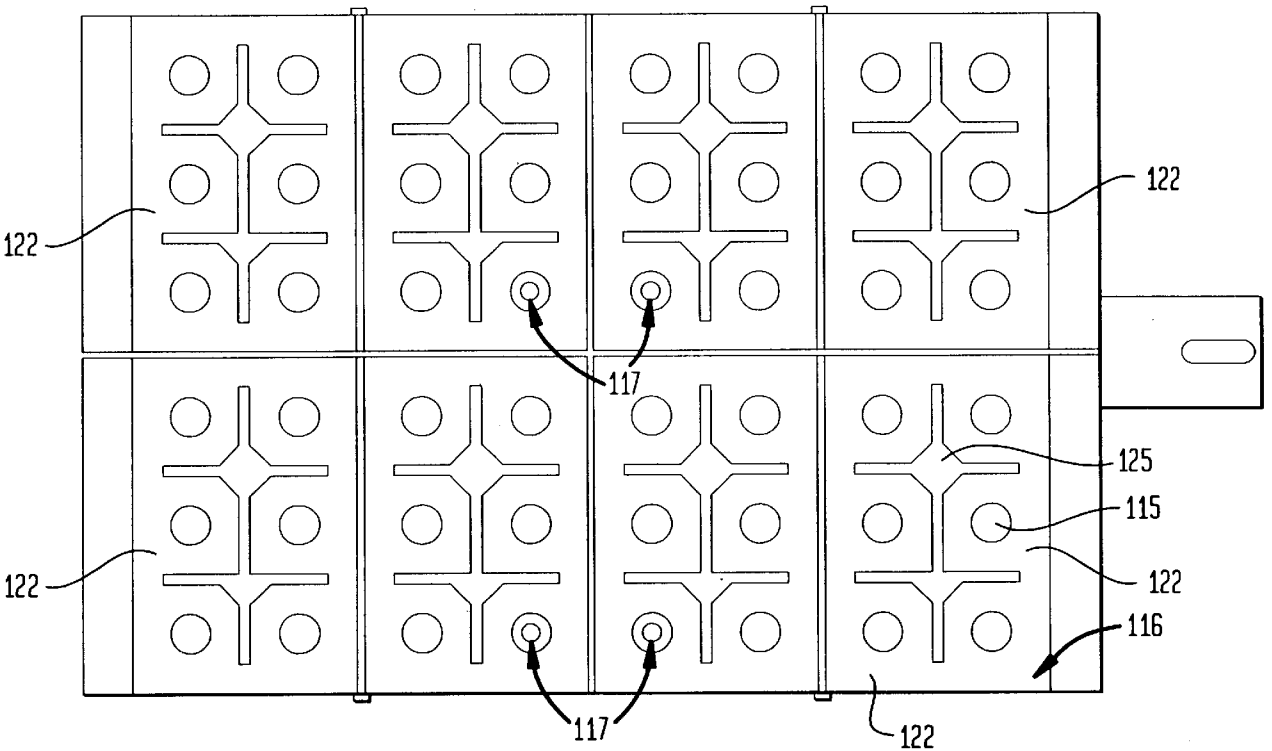
FIG. 7 is a top plan view of a bottom plate in accordance with another aspect of the invention, in the embodiment of FIGS. 1–6.
Figure 7A:
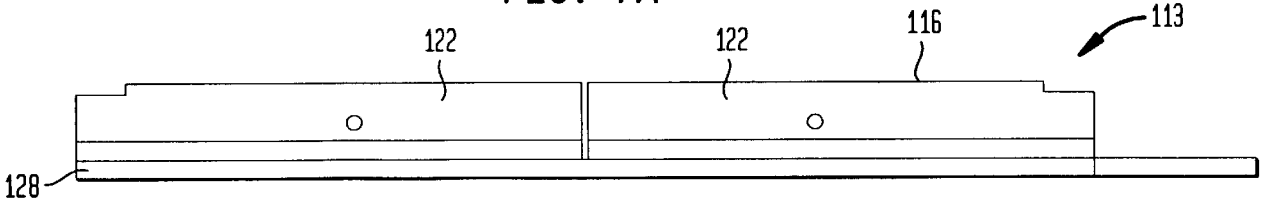
FIG. 7A is a front elevational view of the plate of FIG. 7.
Figure 8:
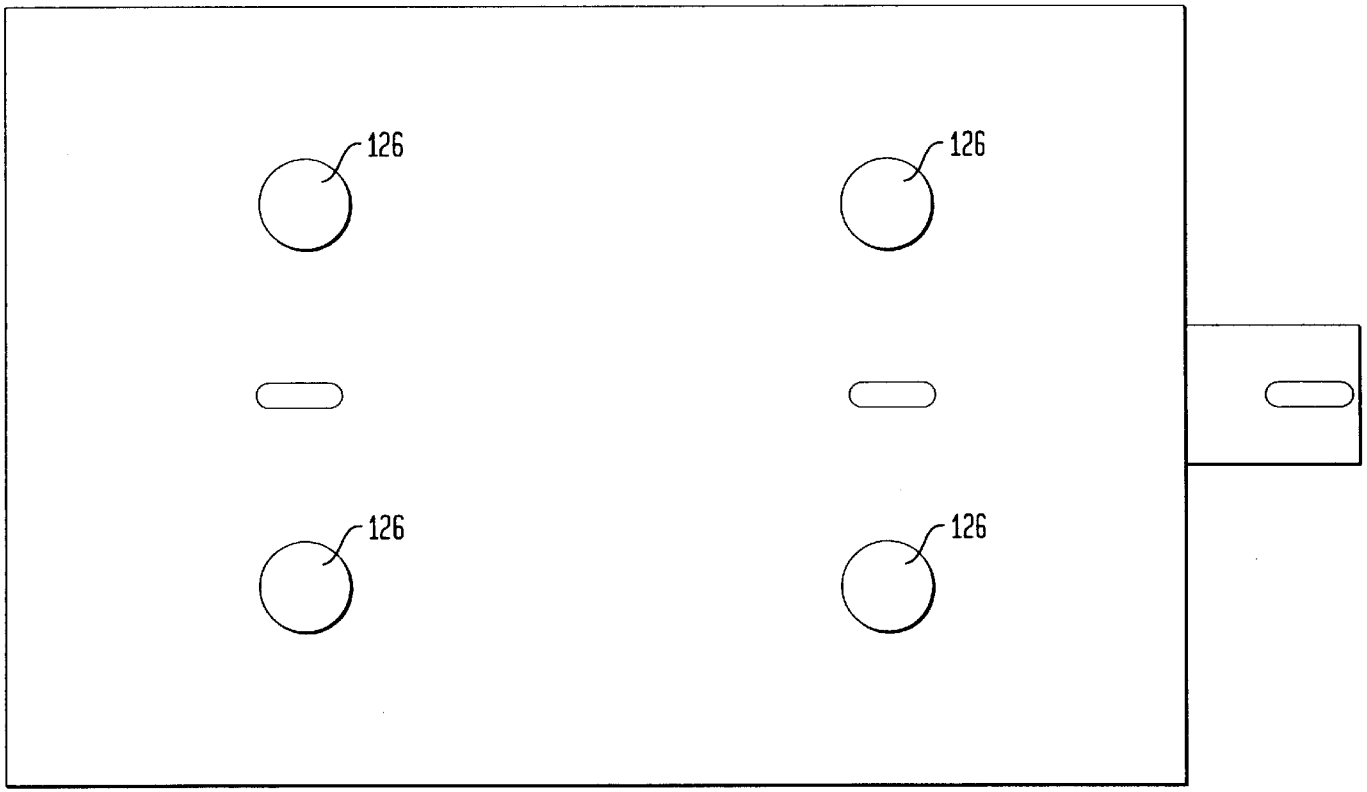
FIG. 8 top plan view of a base for the plate of FIGS. 7–7A.
Figure 8A:
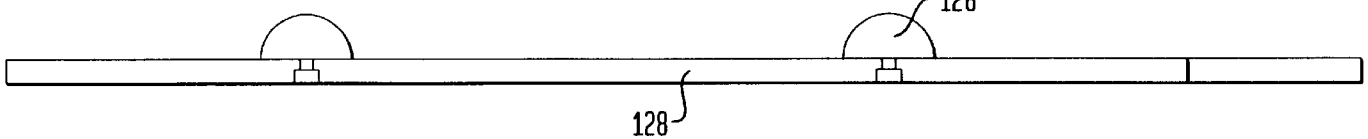
FIG. 8A is a front elevational view of the base of FIG. 8.
Figure 9:
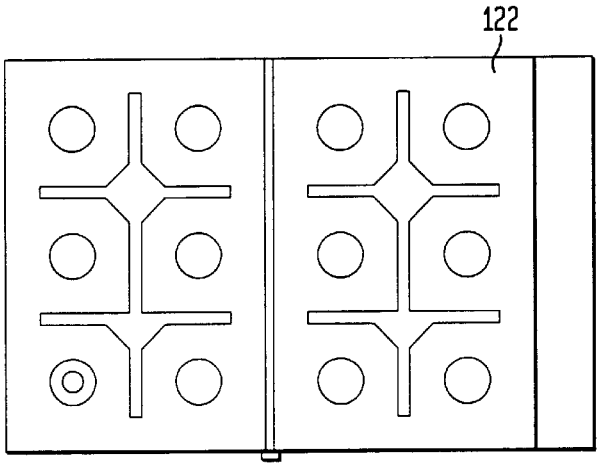
FIG. 9 is a top plan view of a block of the plate of FIGS. 7–7A.
Figure 9A:
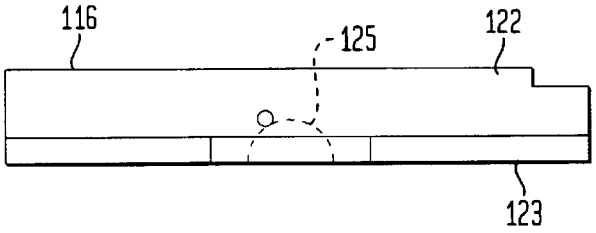
FIG. 9A is a front elevational view of the block of FIG. 9.
Figure 9B:
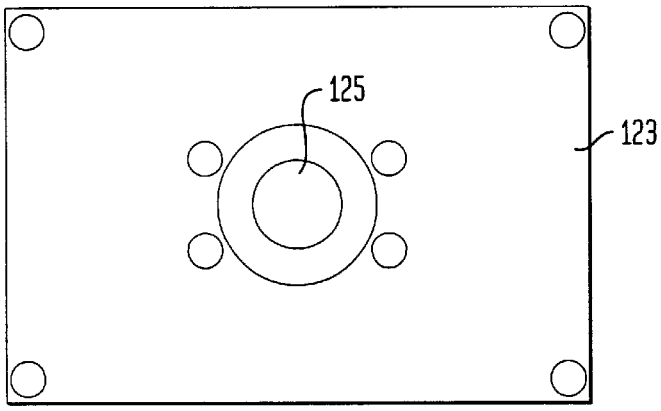
FIG. 9B is a bottom plan view of the block of FIGS. 9–9A.

Another aspect of the invention includes a packaging device for sealing the tablets into packages 110 as depicted in FIGS. 7–9. After the tablets are sealed into packages, the packages are cut into separate cards which are arranged into boxes. The packaging device 90 includes a sealing machine 91 for forming packaged dosage forms. The packages are comprised of first and second sheets of packaging material, preferably foil laminate, which are sealed together in the sealing machine. An example of this type of packaging machine is a Clockner blister-forming machine. Model No. CP11.4 may be used. Blisters 111, which are essentially cup-shaped depressions in the packaging material, have been provided in at least one of the sheets for holding the tablets. In the finished package, which is depicted in FIG. 6, each tablet occupies a pocket formed by the blisters 111. For example, where the product is a relatively fragile tablet, blister packages of the type described concerning certain embodiments of copending, commonly assigned U.S. patent application Ser. No. 09/053,298, filed Apr. 1, 1998, hereby incorporated by reference herein, may be used.

The packaging device 90 is generally of the type known as a "form, fill and seal" machine. The machine forms a web of a packaging material into blisters, whereupon the form handler 83 places the tablets in the blisters. In embodiments having a robotic tablet handler, each suction cup 65 of the robotic handler corresponds to a blister 111 in the packaging material, as depicted in FIG. 4A. The robotic handler received tablets at the pickup area 82 and rotates 180° from position 83C to position 83D, toward the packaging material 112 on support 114. After the arm 66 lowers to the packaging material, the tablets are release into blisters 111. The packaging material advances along a conveyor belt, series of rollers or a similar conveyance device 68 to a sealing machine through a series of checking systems which ensure that the first sheet is free from displaced tablets and debris prior to reaching the sealing machine. At the sealing machine, the packaging material is sealed to a web or sheet of lid stock so that the lid stock closes the blisters and holds the tablets in the blisters.

The sealing machine includes a top and bottom plate. The top and bottom plates of the sealing machine each have sealing faces, for engaging the lid stock and packaging material, respectively. In the embodiment depicted in FIG. 7, blister cavities 115 are provided in the sealing face 116 of the bottom plate 113. Depending upon the type of package formed, the top plate may include blister cavities, as well.

The plates preferably have registration markers 17 so that the top and bottom plates can be properly aligned. At least one of the plates, typically the top plate, is heated so that a heat-activated material in the packaging material or lid stock seals the tablet package when the top and bottom plates are brought into engagement. Most preferably, the bottom plate is also heated. The heaters are connected to controllers for controlling the heating of the plates in the conventional manner.

After receiving tablets from form handling device 83, the web of the packaging material is transferred from support 114 to the sealing face 116 of the bottom plate 113 so that the blisters 111 rest in the blister cavities 115 of the bottom plate 113. The lid stock is placed on the packaging material, overlying the tablets in the blisters and the sealing machine urges the top plate and bottom plate together, so that these plates engage the package material and lid stock therebetween. The top and bottom plates are brought together to seal the packaging material. As is well known in the blister packaging art, sealing occurs according to three (3) parameters: heat, pressure and time.

In preferred embodiments, at least the bottom plate is designed with recessed regions 120 depicted in FIG. 7. The recessed regions apply no pressure to the blister pack material and the sealing face 116 comprises relatively raised regions where the seal is to be formed. This feature focuses the force and heat of the sealing device on the portions of the blister pack where sealing is desired. After a pre-determined sealing time is reached, the plates are disengaged and the sealed blister pack 110 is transported to a blister pack card punch and thereafter to a cartoner for arrangement in boxes. FIG. 6 depicts a blister package for ½" tablets.

In preferred embodiments, at least one of the top and bottom plates is designed to evenly distribute the force and heat of the sealing machine along the sealing faces of the plates. The present invention addresses this problem by providing, rather than one continuous bottom plate 113, a plate comprised of a plurality of blocks 122 which can move with respect to one another over a range of motion. In the particular embodiment illustrated in FIG. 7, four (4) movable blocks 122, are provided. Each block 122, depicted in FIG. 9, has a rear face 123 opposite the sealing face 116 and a circular depression 125 in the rear face. Each block also has a compartment cut out for heaters which communicate with controls for heating the plate, as discussed above. The blocks 122 are formed from metals such as steel, aluminum or the like which are selected according to conventional criteria such as wear resistance and good heat transfer. Each block 122 rests on a ball-like member 126, depicted in FIG. 8, which is attached to a base 128 so that the ball 126 is engaged by the circular depression 125 and each block 122 is floatably supported by the base 128. The spacing of the blocks 122 on the base accommodates individual tilting of each block with respect to the horizontal plane. Thus, each block 122 is free to tilt around any horizontal axis. This design has the benefit of achieving better sealing in the tablet packages. When the top plate descends and engages the blister pack material, lid stock and bottom plate, the various blocks constituting the bottom plate 122 tilt and adjust to achieve an evenly distributed pressure over the blister pack material. After a predetermined sealing time, the plates are released from the package 110, which proceeds to the cartoner.

In other embodiments, more or fewer blocks can be employed. In addition, the tilting movement can be provided by other arrangements, such as a dual-gimbal mount, wherein each block is pivotally mounted to a gimbal frame for tilting movement around a first horizontal axis, and the gimbal frame is pivotally mounted to the base for tilting movement around a second horizontal axis perpendicular to the first horizontal axis. Alternatively, each block can be mounted to the base by a pad of a resilient material such as a high-temperature silicone rubber, or by a set of springs, so that each block is free to move relative to the base in a limited range of tilting movement. In the embodiment shown, the bottom plate has individual blocks, whereas the top plate is a unitary, solid part. However, the reverse arrangement, with a solid bottom plate and a top plate composed of movable parts, can also be employed. In a further alternative, both plates can be formed with movable parts.

As will be readily appreciated, numerous other variations and combinations of the features discussed above will be employed without departing from the present invention. Accordingly, the foregoing description of preferred embodiments should be taken by way of illustration, rather than by way of limitation, of the features discussed above. Other desirable features and functions served by preferred aspects of the invention are set forth in the accompanying drawings and claims which also form parts of this provisional application.

I claim:

1. An assembly for guiding pharmaceutical dosage forms in a packaging assembly, comprising:

(a) a surface movable in a downstream direction;

(b) a laning structure extending in a lateral direction transverse to said downstream direction and defining a plurality of laterally-spaced lanes extending in said downstream direction; and (c) guide wall structures including a curved portion and a wall structure defining a plenum structure upstream of said laning structure, said curved portion guiding dosage forms carried by said surface so that dosage forms enter said plenum structure at a plenum entry adjacent a first side of said laning structure and travel laterally toward a second side of said laning structure before entering said lanes.

2. The assembly of claim 1, comprising a form handling device for receiving dosage forms and transporting dosage forms from said laning structure to a packaging device.

3. The assembly of claim 2 wherein said packaging device includes a top plate and a bottom plate for engaging a packaging material and a lid stock therebetween to seal the packaging material and lid stock together, forming packaged dosage forms.

4. The assembly of claim 3 wherein at least one of said top plate and said bottom plate includes a plurality of blocks and a base for supporting said plurality of blocks, said blocks being floatably supported on the base and individually movable with respect to the base.

5. The assembly of claim 4 wherein said lanes have a downstream end and the assembly comprises a dump gate at said downstream end having an open position and a closed position.

6. The assembly of claim 5, comprising timed controller for opening said dump gate after said handling device receives dosage forms.

* * * * *

UNITED STATES PATENT AND TRADEMARK OFFICE

CERTIFICATE OF CORRECTION

PATENT NO. : 6,269,615 B1
DATED : August 7, 2001
INVENTOR(S) : Jerry Amborn and Vern Tiger It is certified that error appears in the above-identified patent and that said Letters Patent is hereby corrected as shown below:

Column 1,
Line 38, before “improperly” insert -- produce or make --.

Column 3,
Line 65, after “FIG. 8” insert -- is a --.

Column 4,
Line 7, delete “FIG. 4 is a”.
Line 47, delete “is”.

Column 5,
Line 4, delete “is”.
Line 17, change “depends” to -- depend --.

Column 7,
Line 26, change “move” to -- moves --.

Column 8,
Line 46, change “release” to -- released --.

Column 10,
Line 59, after “comprising” insert -- a --.

Signed and Sealed this

Twenty-third Day of July, 2002

*Attest:*

*Attesting Officer*

JAMES E. ROGAN
*Director of the United States Patent and Trademark Office*